US005185214A

United States Patent [19]

LeVan et al.

[11] Patent Number: 5,185,214

[45] Date of Patent: Feb. 9, 1993

[54] ONE STEP PROCESS FOR IMPARTING DECAY RESISTANCE AND FIRE RETARDANCY TO WOOD PRODUCTS

[76] Inventors: Susan L. LeVan, 716 Glenview Dr., Madison, Wis. 53716; Rodney C. DeGroot, 1408 Arrowood Dr., Madison, Wis. 53704

[21] Appl. No.: 714,402

[22] Filed: Jun. 12, 1991

[51] Int. Cl.[5] ..... B27K 3/50

[52] U.S. Cl. ..... 428/541; 106/15.05; 106/18.15; 106/18.18; 106/18.21; 106/18.3; 106/18.31; 106/18.32; 106/18.35; 252/607; 427/297; 427/439; 427/440; 428/921

[58] Field of Search ..... 427/297, 392, 393, 396, 427/397, 439, 440; 428/541, 921, 537.1; 252/607; 424/413; 260/DIG. 24; 106/15.05, 18.13, 18.14, 18.15, 18.17, 18.18, 18.21, 18.3, 18.31, 18.32, 18.35

[56] References Cited

U.S. PATENT DOCUMENTS

| | | | |
|---|---|---|---|
| 2,143,639 | 1/1939 | Caprio | 427/440 |
| 2,295,504 | 9/1942 | Shelton et al. | 514/642 |
| 2,694,663 | 11/1954 | Stayner | 514/642 |
| 2,917,408 | 12/1959 | Goldstein et al. | 428/541 |
| 3,159,503 | 12/1964 | Goldstein et al. | 428/541 |
| 3,366,672 | 1/1968 | Wakeman et al. | 106/18.18 |
| 3,832,316 | 8/1974 | Juneja | 524/598 |
| 3,836,669 | 9/1974 | Dadekian | 514/642 |
| 3,887,511 | 6/1975 | Juneja | 524/843 |
| 3,925,137 | 12/1975 | Kamei | 156/278 |
| 3,986,881 | 10/1976 | Oberley | 106/18.15 |
| 4,010,296 | 3/1977 | Oberley | 427/393 |
| 4,123,575 | 10/1978 | Wesch | 427/386 |
| 4,254,177 | 3/1981 | Fulmer | 428/256 |
| 4,273,687 | 6/1981 | Cummins et al. | 523/447 |
| 4,301,217 | 11/1981 | Rohringer et al. | 427/393 |
| 4,373,010 | 2/1983 | Oberley | 428/921 |
| 4,444,790 | 4/1984 | Green et al. | 424/329 |
| 4,461,720 | 7/1984 | Loyvet et al. | 252/607 |
| 4,468,495 | 8/1984 | Pearson | 252/607 |
| 4,510,074 | 4/1985 | Nakai et al. | 427/440 |
| 4,950,685 | 8/1990 | Ward | 514/479 |

FOREIGN PATENT DOCUMENTS

| | | | |
|---|---|---|---|
| 1-186302 | 7/1989 | Japan | 427/297 |
| 1-257005 | 10/1989 | Japan | 427/440 |
| 1021248 | 3/1966 | United Kingdom | 260/DIG. 24 |

*Primary Examiner*—Michael Lusignan
*Assistant Examiner*—Terry J. Owens
*Attorney, Agent, or Firm*—M. Howard Silverstein; John D. Fado; Janet I. Stockhausen

[57] ABSTRACT

A one step process for imparting both decay resistance and fire retardancy to wood and cellulosic materials by impregnating the products with a treatment solution composed of a water soluble mixture of a tertiary and quaternary ammonium preservative compound and an organic phosphate fire retardant compound.

19 Claims, 2 Drawing Sheets

ONE STEP PROCESS FOR IMPARTING DECAY RESISTANCE AND FIRE RETARDANCY TO WOOD PRODUCTS

BACKGROUND OF THE INVENTION

1. Field of the Invention

This invention relates to a one step process for imparting both fire retardancy and resistance to wood destroying organisms to products composed primarily of perishable cellulosic materials, particularly those having wood as a major component of the product. The principal utility of the invention will be practiced by industries producing wood roofing materials, decks, foundations, poles, and industrial construction materials. However, the invention may provide the decay resistant and fire retardant benefits to a large variety of other products for use in settings other than those mentioned.

2. Description of the Prior Art

Wood products have been treated with both a variety of chemicals and treatment methods to attempt to achieve the desired levels of effectiveness for both fire retardancy and decay resistance. Present methods have focused on initially treating the wood for either fire retardancy or decay resistance, followed by a drying phase, and a second treatment for the remaining desired characteristic. However, those methods have not been entirely satisfactory for a variety of reasons, such as the extra energy and handling associated with the drying phase, insufficient penetration of the second treatment due to the spaces in the wood product being filled to capacity with the first treatment, and less than satisfactory levels of effectiveness for one or both of the desired characteristics.

The prior art is basically divided into fire retardant compounds and systems and decay compounds and systems.

It has long been known that certain compounds will impart decay resistance to wood products. Examples of compounds known to have decay resistant qualities include oil-borne preservatives such as creosote and pentachlorophenol, tertiary and quaternary ammonium compounds, didecyl dimethyl ammonium chloride, some heavy metals, such as copper and zinc, and certain compounds containing boron.

It has also been known that certain compounds will impart fire retardant qualities to wood products. Examples of compounds known to have fire retardant qualities include mixtures containing a combination of dicyandiamide, formaldehyde, and phosphorus (often in the form of phosphoric acid) and sometimes urea or melamine.

The first group of patents listed all generally pertain to fire retardant compositions, methods related to imparting fire resistance to wood products, and products resulting from the use of either or both the composition and the methods.

| U.S. Pat. No. | Inventor |
|---|---|
| 2,295,504 | R. S. Shelton |
| 2,694,663 | R. D. Stayner |
| 2,917,408 | I. S. Goldstein et al. |
| 3,159,503 | I. S. Goldstein et al. |
| 3,832,316 | S. C. Juneja |
| 3,836,669 | Z. A. Dadekian |
| 3,887,511 | S. C. Juneja |
| 3,925,137 | M. Kamei |

-continued

| U.S. Pat. No. | Inventor |
|---|---|
| 3,986,881 | W. J. Oberley |
| 4,010,296 | W. J. Oberley |
| 4,123,575 | L. Wesch et al. |
| 4,254,177 | G. E. Fulmer |
| 4,273,687 | R. W. Cummins et al. |
| 4,444,790 | H. A. Green |
| 4,461,720 | A. G. Loyvet et al. |

U.S. Pat. No. 2,917,408 is primarily directed to a method for impregnating wood for flame retardance and stabilization against dimensional change with a specified solution of dicyandiamide, phosphoric acid, and water followed by a heat treatment. A further aspect of the invention relates to the addition of certain zinc or copper compounds for enhanced resistance to fungal decay.

U.S. Pat. No. 3,159,503 relates to the chemical treatment of wood with a solution of dicyandiamide, phosphoric acid, formaldehyde, and water followed by a heat treatment. That treatment involves an impregnation technique which renders the wood fire retardant, stabilized against dimensional change, and reduces its hygroscopicity. This patent is also directed to a leach-resistant, fire retardant product and a method for producing that product.

U.S. Pat. No. 3,832,316 is directed to resin solutions primarily of melamine, dicyandiamide, formaldehyde, and an oxy-acid of phosphorus which are suitable for fire retardant and adhesive applications.

U.S. Pat. No. 3,887,511 is concerned with aqueous solutions, and methods for preparing the same, of incompletely reacted urea compounds, dicyandiamide, formaldehyde, and an oxy-acid of phosphorus to render wood and cellulosic products fire retardant and decay resistant.

U.S. Pat. No. 3,925,137 relates to a method for forming a flame retardant clear coat which is accomplished by first applying a flame retardant foaming paint, then attaching a decorative material, and lastly a flame retardant clear coat. The compositions for the foaming paint and the clear coat are taught.

U.S. Pat. No. 3,986,881 discloses wood treatment chemical compositions, both aqueous and solid, of monomethylol dicyandiamide, melamine, and phosphoric acid which impart fire retardant qualities as well as leach resistance and do not increase the hygroscopicity of the wood.

U.S. Pat. No. 4,010,296, a divisional of Patent No. 3,986,881, is directed to methods of treating wood for imparting desirable properties related to low hygroscopicity, leach resistance, and fire retardance.

U.S. Pat. No. 4,123,575 relates to a fire retarding, foam-forming epoxy resin and a method for applying the same.

U.S. Pat. No. 4,254,177 is directed to articles having fire retardant qualities. The articles have a foraminous core and an adherent outer layer containing fire retardant fillers.

U.S. Pat. No. 4,273,687 relates to a guanidine phosphate composition which renders cellulosic materials, such as hardboard, fire retardant.

U.S. Pat. No. 4,461,720 discloses a fire retardant composition for treating wood prepared by converting dicyandiamide, through a series of steps, into phosphate salt of the methylolated guanyl urea.

The second group of patents all generally pertain to compositions and methods related to imparting decay resistance or displaying biocide action to wood products. Following is a list of related prior art patents.

| U.S. Pat. No. | Inventor |
|---|---|
| 2,294,504 | R. S. Shelton |
| 2,694,663 | R. D. Stayner |
| 3,836,669 | Z. A. Dadekian |
| 4,444,790 | H. A. Green |
| 4,950,685 | H. A. Ward |

U.S. Pat. No. 2,295,504 is directed to a compound or compounds of the class of tertiary and quaternary ammonium compounds which possess bactericidal, antiseptic, fungicidal, and related germ counteracting properties.

U.S. Pat. No. 2,694,663 discloses a composition for the control of micro-organisms comprising a quaternary ammonium germicide and a neutral hydrocarbon oil promoter.

U.S. Pat. No. 3,836,669 teaches a method involving the use of didecyl dimethyl ammonium chloride for the purpose of killing bacteria in the presence of hard water and blood serum.

U.S. Pat. No. 4,444,790 relates to the use of a quaternary ammonium compound as a disinfectant in the presence of hard water or organic soil.

U.S. Pat. No. 4,950,689 relates to the combination of didecyl dimethyl ammonium chloride with 3-iodo-2-propynyl-butyl carbamate for the purpose of providing decay resistance to wood products.

SUMMARY OF THE INVENTION

The present invention relates to a one step chemical treatment of wood products for both fire retardant and decay resistant qualities whereby the utilization of that wood product is greatly increased due to both the number of uses for which the wood can be used, as well as the duration of time the wood product will withstand environmental degradation without a loss of the desired characteristics. Heretofore, most processes for imparting both fire retardance or decay resistance to wood products encountered a number of disadvantages which resulted in decreased effectiveness or additional cost to achieve the desired effectiveness level of fire resistance or decay resistance.

Following the teaching of the invention, the products are treated using a standard industrial process with a solution containing a combination of commercially available compounds which are capable of imparting both fire retardance and decay resistance in a one step process.

The fire retardant compounds which may successfully be used by those skilled in the art to practice the invention are chosen from a broad class of compounds including organic phosphates. More specifically, the compounds are the guanyl urea phosphates, including the amino-resins. Examples of some of the fire retardant compounds that have been found to be effective are urea, dicyandiamide, phosphoric acid, and formaldehyde (UDPF), melamine, dicyandiamide, phosphoric acid, and formaldehyde (MDPF), or dicyandiamide, phosphoric acid, and formaldehyde (DPF). Two of the possible fire retardants are covered under patents: U.S. Pat. No. 3,887,511 discloses UDPF and Canadian Patent No. 907,233 discloses MDPF.

The decay resistant compounds, which are also known as biocides or preservatives, used to practice this invention may be chosen from a broad group including tertiary and quaternary ammonium compounds and some compounds containing boron. These biocides are known to those skilled in the art and some are registered with the Environmental Protection Agency. Importantly, the decay resistant compounds are compatible with water soluble exterior fire retardants thus enabling a water soluble treatment solution. Examples of some of the decay resistant compounds that one skilled in the art could achieve satisfactory results of wood preservation with include the quaternary ammonium compounds, such as didecyl dimethyl ammonium chloride (DDAC) or a combination of the didecyl dimethyl ammonium chloride with 3-iodo-2-propynyl-butyl carbamate (a patented composition (U.S. Pat. No. 4,950,685) and sold under the registered tradename of NP-1).

In accordance with this discovery, one object of the invention is to provide a one step process for imparting both decay resistance and fire retardance. Prior practice in this art has generally involved the use of two separate treatment steps for the application of the fire retardant and the decay resistant solutions. Thus, a first solution is applied, then the wood product must be dried, followed by the application of a second solution. The added expense, handling and time resulting from the drying cycle is undesirable. In addition, there is decreased penetration of the second solution because the spaces in the wood which are available for saturation with the second solution have been previously filled with the first solution. Therefore, it follows that the second solution will have significantly decreased effectiveness as well.

One disadvantage of some of the prior art is the use of organic solvents for dispersion of the fire resistant or decay resistant chemicals into the wood. Organic solvents are often difficult to handle due to combustibility problems frequently requiring additional safety procedures for safe usage both in the laboratory and in the field. In addition, organic solvents may present problems or added expense associated with the safe disposal of excess material and/or by-products.

Another object of the invention is to provide a solution that will provide the desired performance levels for both fire retardance and wood preservation, while at the same time providing for a solution that will be stable under normal working conditions and not be subject to undue deterioration, and thereby loss of effectiveness, for reasonable periods of time.

Yet another object of the invention is to provide a treatment solution that does not incorporate the use of heavy metals, such as chromium, and thereby has a lower level of toxicity than previous treatments. Heavy metals are now known to be associated with a number of problems including health, disposal, and environmental.

It is a particular object of the invention to provide a composition and method for imparting fire retardance and decay resistance to wood products that may be adapted to rendering the wood product usable for either or both interior and exterior purposes. Depending upon the intended end use for a particular wood product, the relative penetration of a decay resistant or fire retardant solution into a wood product is critical. If the wood product's intended use is limited to interior use, then surface application of the solution may provide satisfactory results because the wood product will not be subjected to the effects of weathering, and thereby the associated leaching of the solutions from the wood product. However, if the wood product's intended use is for exterior settings, or a combination of exterior and interior settings, then surface application alone of a solution will not provide the desired levels of decay resistance and fire retardance because the solutions containing the compounds will not have penetrated into the interior of the wood product and thus will be subject to leaching from the surface and thereby decreased effectiveness due to a loss of the solution. Therefore, deep penetration into the wood product of both the decay resistant and fire retardant solutions is required in order to provide a satisfactory level of performance of the solutions for the desired qualities. The invention is adaptable to this variety of penetration requirements because of the numerous application methods which can be used effectively.

Yet another object of the invention is to provide a solution that will be equally effective on all wood products from treatable species of trees. Additionally, a further related object of the invention is to provide a treatment method that is equally adaptable to and effective on cellulosic products, as it is to wood products, thereby providing for a treatment method for products which are formed from a combination of wood, other cellulosic materials, and possibly other materials.

Another object of the invention is to provide an effective decay resistant and fire retardant solution that will be equally effective with a variety of application methods.

Still another object of the invention is to provide a composition in which the decay resistant component and the fire retardant component are at least as effective as each of the respective compositions would be if used alone and in which the combination of compositions does not decrease the effectiveness of either of the compositions. Additionally, a related object of the invention is to provide a composition in which the respective components seem to provide a synergistic effect in that the effectiveness of the overall process is enhanced by the particular combination of chemical components taught. Thus, the one step process of the invention provides for a process in which the decay resistant and fire retardant compositions together provide a more effective system than either one of the processes are able to provide alone.

More particularly, it is an object of this invention to provide a unique combination, i.e. an effective one step process for imparting both fire retardance and resistance to biological agents known to degrade wood and cellulosic materials, that does not currently exist in either the preservative or fire retardant prior art. Some of the prior art acknowledges that the combination of a fire retardant and a decay resistant compound may be possible, but a combination process has largely been unaccepted by those practicing in this area.

A further object of the invention is to provide a method which also enhances the dimensional stability of the wood product while at the same time providing the desired levels of effectiveness for both fire retardance and decay resistance.

Yet another object of the invention is to provide a preservative treatment method which is effective for wood and cellulosic materials by providing durability against wood destroying organisms, such as wood decay fungi, bacteria, and wood destroying insects including, among others, termites, beetles and bees.

It is a particular object of the invention to provide a treatment composition that does not require an additional Environmental Protection Agency registration prior to the use of the composition because the components of the invention are already commercially available.

Thus, it is clear that a one step process for imparting both fire retardance and decay resistance to wood products that is environmentally safe, easy to handle, practical, effective, and economical is needed. The present invention aims to provide a process which addresses these requirements.

Other objects and advantages of the invention will become readily apparent from the ensuing description.

DETAILED DESCRIPTION OF THE INVENTION

Figure 1:
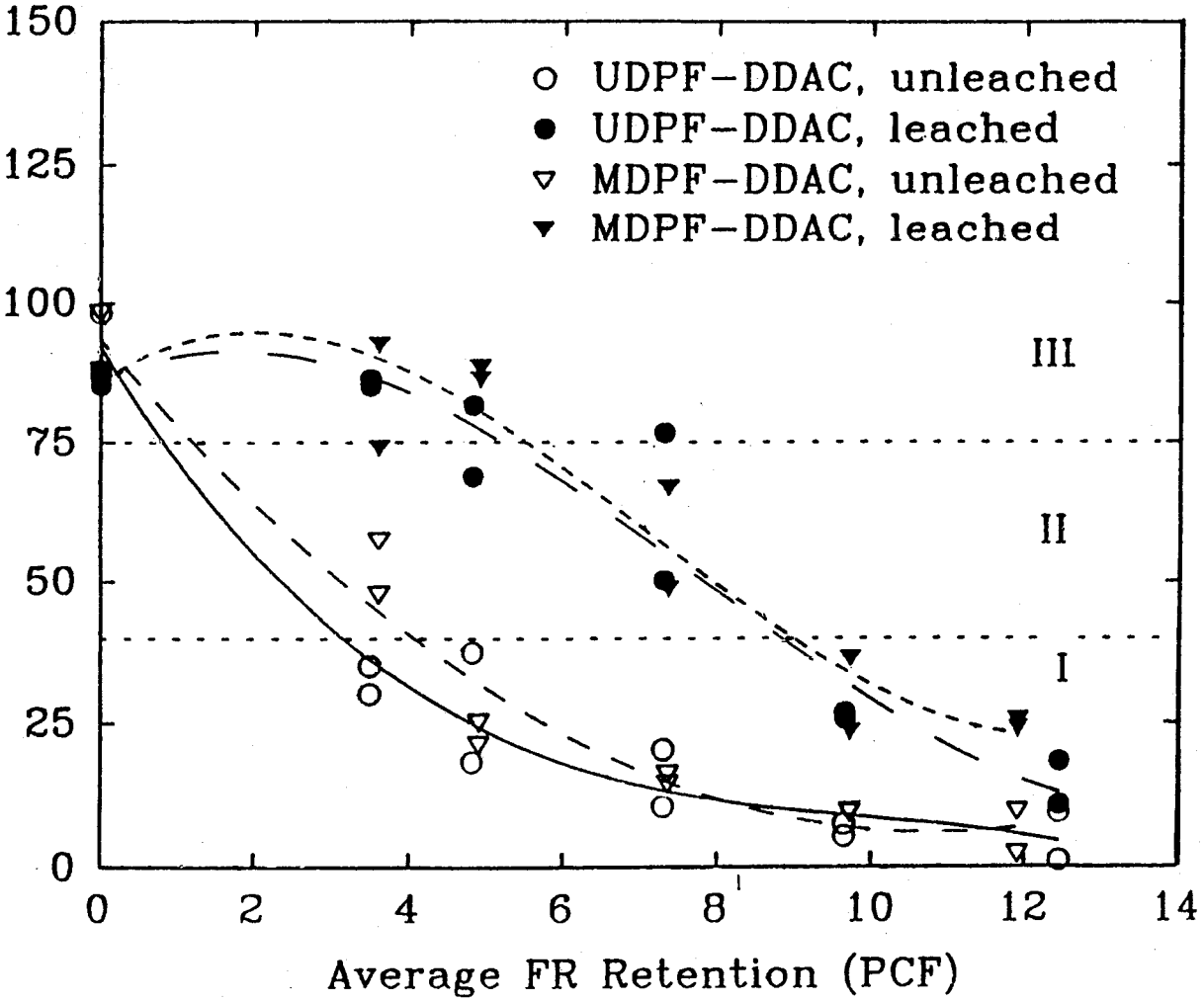
FIG. 1 Effect of leaching on heat release rate versus combined system retention as measured in pounds per cubic foot.

In accordance with the present invention, a one step process for imparting both decay resistance and fire retardancy to wood products is provided. The one step process involves the use of a mixture of commercially available decay resistant and fire retardant compositions in an aqueous solution.

The decay resistant compositions that are to be used in the invention are chosen from the group including tertiary and quaternary ammonium compounds and some compounds containing boron. Good results have been achieved using some examples of the quaternary ammonium group. One of the decay resistant compositions which has provided the desired levels of effectiveness id didecyl dimethyl ammonium chloride (DDAC) which is marketed by Lonza, Inc. under the registered tradename BARDAC 2280. Another decay resistant composition which has provided the desired efficacy levels is the compound ammonium chloride in combination with 3-iodo-2-propynyl butyl carbamate. That compound is sold under the registered tradename NP-1, is covered by U.S. Pat. No. 4,950,685, and is marketed by Kop-Coat, Inc.

Generally, low percentages by weight of the compounds providing the resistance to wood destroying organisms in comparison to the overall composition have been found to be effective in preserving products composed of wood or cellulosic materials. Specifically, the quaternary ammonium compounds tested have been found to be most effective in the range of 0.19% to 7.5% for the DDAC and 0.09% to 7.5% for the NP-1. However, due to the variability of the different types of wood generally, the compositions of products, end uses of products, uptake of the treatment solution into the product, and other parameters, effective levels of both decay resistance and fire retardance may be achieved outside of these ranges. Thus, the relative concentration of the solutions may vary considerably while still achieving the desired levels of effectiveness. Those skilled in the art would find the optimum levels without difficulty via routine experimentation.

The decay resistant compositions disclosed in this invention have proven to be effective in preventing the invasion of biological agents and wood destroying organisms, such as wood decay fungi, bacteria, and wood destroying insects, including beetles, termites, and the like. Specifically, the compositions disclosed have been shown to be effective against both white rot fungi, for example *Coriolus versicolor,* and brown rot fungi, for example *Gleophyllum trabeum.*

The fire retardant compositions are selected from a broad class of compounds known as the organic phosphates. More particularly, the compounds used to practice the invention are chosen from the guanyl urea phosphates, and more specifically the amino-resins. Satisfactory results have been obtained using MDPF and UDPF, both of which are amino-resins. However, other members of the above listed chemical classes may also provide satisfactory results. One skilled in the art would be able to achieve the desired results through routine experimentation.

The concentration of fire retardant in the solution which would provide the desired level of effectiveness could be ascertained by on skilled in the art through routine experimentation. The amino-resins UDPF and MDPF have been found to be most effective in the range of 7.5% to 25%. The same parameters which impact the choice of the relative concentration of the decay resistant solution in the total solution will also impact the relative concentration of the fire retardant solution in the total solution.

The commercially available fire retardant and decay resistant compositions are mixed following standard laboratory methods for mixing aqueous solutions such as these. Variations known to those skilled in the art to achieve the desired treatment solution are assumed. Again, the ranges of the respective concentrations of the solutions can be varied to provide the greatest effectiveness and utility for a given product's end use, composition, relative ease of uptake of the treatment solution by the product, and other factors familiar to those skilled in the art. Thus, a product intended for use in which it will be particularly susceptible to decay, e.g. a warm, humid environment, may require a greater concentration of decay resistant solution and a lesser concentration of the fire retardant solution, whereas, for a product intended for use in application with high fire hazard and with minimal exposure to decay causing elements, a greater concentration of fire retardant solution and a lesser concentration of decay resistant solution may be desired.

The method of treating the wood product to achieve the desired level of penetration may vary depending upon the product which is being treated, the intended end use, the wood and other materials incorporated into the product, and a large variety of other factors to be considered when making a determination as to the best treatment method for a given product. Some of the known impregnation techniques include full cell pressure impregnation, vacuum soaking, diffusion, and dip treatments, among others. Both pressure and non-pressure application techniques are capable of providing the desired level of effectiveness for both decay resistance and fire retardance.

The present invention discloses use of the full cell pressure impregnation technique which is defined by the American Wood Preservers Association Treating Standards. The full cell pressure impregnation technique involves subjecting the wood and other materials to be treated to a vacuum, followed by application of treating solution using pressure.

Numerous experiments have been performed which demonstrate the effectiveness of this invention. The following examples illustrate the invention but should not be construed to limit the same.

EXAMPLE 1

Composition of Fire Retardant Solution, UDPF 24.4 lbs. of 35% formaldehyde, having an approximate pH of 2, was adjusted with 3N sodium hydroxide to a pH of 10. 3.2 lbs. of urea and 13.4 lbs. of dicyandiamide were added with agitation. The solution was sized until dissolved. 24.4 lb. of 85% phosphoric acid was added to solution slowly so that the reaction temperature never exceeds 60 degrees C. The reaction vessel was kept in an ice bath to maintain the temperature below 60 degree C. After all the phosphoric acid was added, the solution was diluted with 24.4 lbs. of distilled water to attain a 100 lbs. of 50% fire retardant solution, called UDPF. The solution has a pot life of several months and was diluted to the appropriate concentration for the subsequent examples.

EXAMPLE 2

Composition of Fire Retardant Solution, MDPF 43.1 lbs. of 35% formaldehyde, having an approximate pH of 2, was adjusted with 3N sodium hydroxide to a pH of 10. The formaldehyde solution was heated to 70 degrees C. 5.8 lbs. of melamine and 11.2 lbs. of dicyandiamide were added with agitation. The solution was mixed until dissolved. The solution was then cooled until the temperature was approximately 30 degrees C. The reaction vessel was kept in an ice bath to maintain the temperature below 60 degrees C. during the addition of 20.4 lbs. of 85% phosphoric acid. In addition, the phosphoric acid was added very slowly to maintain the temperature below 60 degrees C. After all the phosphoric acid was added, the solution was diluted with 19.6 lbs. of distilled water to attain a 100 lbs. of 50% fire retardant solution, called MDPF. The solution has a pot life of less than 1 month and was diluted to the appropriate concentration for the subsequent examples.

EXAMPLE 3

Composition of Preservative and Fire Retardant Solutions

The above fire retardant solutions were diluted with distilled water and preservative to attain fire retardant concentrations from 7.5% to 25% and preservative concentrations from 0.19% to 7.5% for the preservative didecyldimethylammonium chloride, (DDAC) tradename BARDAX 2280, and from 0.05% to 7.5% for the proprietary preservative, NP-1. The resulting solutions were then evaluated for preservative and fire retardancy effectiveness.

EXAMPLE 4

UDPF+DDAC, Preservative Effectiveness

Treated, cured wood blocks were evaluated for resistance to attack by two wood decay fungi, *Gleophyllum trabeum* (isolate Madison 617) and *Coriolus versicolor* (Madison isolate 697) employing the so-called soilblock test set forth in ASTM D 1413-78. The decay resistance of $\frac{3}{4}'' \times \frac{3}{4}'' \times \frac{3}{4}''$ southern pine sapwood blocks, treated with a mixture of 10% or 30% UDPF plus DDAC at concentrations of either 0.75%, 1.50% or 7.50% DDAC was compared with the decay resistance of southern pine sapwood blocks treated with UDPF (10, 30 or 50% solutions) alone, and with the decay resistance of southern pine sapwood blocks treated with DDAC alone at concentrations of 0.19, 0.38, 0.75, 1.50 and 3.00% DDAC.

Untreated southern pine sapwood blocks were used as controls. The impregnation treatment was as described in ASTM D 1413-78. Blocks were subjected to vacuum at 28 in. Hg for thirty minutes, flooded with the treating solution while under vacuum and, then, held under the solution at atmospheric pressure for at least 30 minutes. This procedure simulates the indepth penetration achieved in dimension materials in an industrial treatment using the full cell process. All treated blocks were leached in accordance with procedures described in ASTM D 1413-78 prior to exposure to the decay fungi. In the table below, the mean, percent weight loss due to attack by either of the decay fungi in 5 replicate blocks is set forth.

TABLE 1

| Chemical component | UDPF % | DDAC % | Percent weight loss due to attack by the decay fungi: *G. trabeum* | *C. versicolor* |
|---|---|---|---|---|
| DDAC + UDPF | 10 | 0.75 | 12.18 | 1.97 |
| DDAC + UDPF | 10 | 1.50 | 6.28 | 2.02 |
| DDAC + UDPF | 10 | 7.50 | 1.20 | 1.37 |
| DDAC + UDPF | 30 | 0.75 | 7.25 | 1.35 |
| DDAC + UDPF | 30 | 1.50 | 1.67 | 1.19 |
| DDAC + UDPF | 30 | 7.50 | 0.56 | (−0.03) |
| DDAC | | 0.19 | 42.17 | 19.34 |
| DDAC | | 0.38 | 34.91 | 11.88 |
| DDAC | | 0.75 | 26.00 | 2.97 |
| DDAC | | 1.50 | 10.20 | 0.76 |
| DDAC | | 3.00 | 4.22 | (−0.82) |
| UDPF | 10 | | 38.64 | 10.53 |
| UDPF | 30 | | 7.27 | 2.80 |
| UDPF | 50 | | 2.57 | 3.41 |
| Control | 0 | 0.00 | 37.15 | 30.83 |

A synergistic effect between the two components of this mixture in suppressing brown rot decay fungi occurred as shown below:

Percent reduction in attack by *G. trabeum* as determined by comparing % weight lost due to decay in treated blocks with % weight lost due to decay in untreated, control blocks.

| Chemical treatment | Reduction in decay caused by *G. trabeum* % |
|---|---|
| 0.75% DDAC, alone | 11.15 |
| 10% UDPF, alone | (+1.49) |
| Sum of % reduction by above | 9.66 |
| combined treatment = (0.75% DDAC + 10% UDPF) | 64.52 |

EXAMPLE 5

MDPF+DDAC, Preservative Effectiveness

Treated, cured wood blocks were evaluated for resistance to attack by two wood decay fungi, *Gleophyllum trabeum* (isolate Madison 617) and *Coriolus versicolor* (Madison isolate 697) employing the so-called soilblock test set forth in ASTM D 1413-78. The decay resistance of ¾"×¾"×¾" southern pine sapwood blocks, treated with a mixture of 10% or 30% MDPF and DDAC at concentrations of either 0.75%, 1.50% or 7.50% DDAC was compared with the decay resistance of southern pine sapwood blocks treated with MDPF (10, or 30% solutions) alone, and with the decay resistance of southern pine sapwood blocks treated with DDAC alone at concentrations 0.19, 0.38, 0.75, 1.50 and 3.0% DDAC. Untreated southern pine sapwood blocks were used as controls. The impregnation treatment was as described in ASTM D 1413-78. Blocks are subjected to vacuum at 28 in. Hg for thirty minutes, flooded, while under vacuum with the treating solution, and then held under the solution at atmospheric pressure for at least 30 minutes. This procedure simulates the indepth penetration achieved in dimension materials in industrial treatments with the full cell procedures described in ASTM D 1413-78 prior to exposure to the decay fungi. In the table below, the mean, percent weight loss due to attack by either of the decay fungi in 5 replicate blocks is set forth.

TABLE 2

| Chemical component | MDPF % | DDAC % | Percent weight loss due to attack by the decay fungi: *G. trabeum* | *C. versicolor* |
|---|---|---|---|---|
| DDAC + MDPF | 10 | 0.75 | 11.89 | 3.15 |
| DDAC + MDPF | 10 | 1.50 | 7.73 | 3.50 |
| DDAC + MDPF | 10 | 7.50 | 7.43 | 0.55 |
| DDAC + MDPF | 30 | 0.75 | 4.53 | 1.93 |
| DDAC + MDPF | 30 | 1.50 | 1.88 | 1.46 |
| DDAC + MDPF | 30 | 7.50 | 0.79 | 0.72 |
| DDAC | | 0.19 | 42.17 | 19.34 |
| DDAC | | 0.38 | 34.91 | 11.88 |
| DDAC | | 0.75 | 26.00 | 2.97 |
| DDAC | | 1.50 | 10.20 | 0.76 |
| DDAC | | 3.00 | 4.22 | (−0.82) |
| MDPF | 10 | | 34.08 | 9.00 |
| MDPF | 30 | | 4.65 | 3.12 |
| Control | 0 | 0.00 | 37.15 | 30.83 |

A synergistic effect between the two components of this mixture in suppressing brown rot decay fungi occurs as shown below:

Percent reduction in attack by *G. trabeum* as determined by comparing % weight lost due to decay in treated blocks with % weight lost due to decay in untreated, control blocks.

| Chemical treatment | Reduction in decay caused by *G. trabeum* % |
|---|---|
| 0.75% DDAC, alone | 11.15 |
| 10% MDPF, alone | 8.26) |
| Sum of % reduction by above | 19.41 |
| combined treatment = (0.75% DDAC + 10% MDPF) | 67.99 |

EXAMPLE 5

UDPF+NP1, Preservative Effectiveness

Treated, cured wood blocks were evaluated for resistance to attach by two wood decay fungi, *Gleophyllum trabeum* (isolate Madison 617) and *Coriolus versicolor* (Madison isolate 697) employing the so-called soilblock test set forth in ASTM D 1413-78. The decay resistance of ¾"×¾"×¾" southern pine sapwood blocks, treated with a mixture of 10% UDPF and 0.75% NP1 was compared with the decay resistance of southern pine sapwood blocks treated with UDPF (10, 20 or 30% solutions) alone, and with the decay resistance of southern pine sapwood blocks treated with NP1 alone at concentrations of 0.05, 0.09, 0.19, 0.37, 0.75, 1.50 and 3.0% DDAC. Untreated southern pine sapwood blocks were used as controls. The impregnation treatment was as described in ASTM D 1413-78. Blocks are subjected to vacuum at 28 in. Hg for thirty minutes, flooded, while under vacuum with the treating solution, and then held under the solution at atmospheric pressure for at least 30 minutes. This procedure simulates the indepth penetration achieved in dimension materials in an industrial full cell treatment. All treated blocks were leached in accordance with procedures described in ASTM D 1413-78 prior to exposure to the decay fungi. In the table below, the mean, percent weight loss due to attack by either of the decay fungi in 5 replicate blocks is set forth.

TABLE 3

| Chemical component | UDPF % | NP1 % | Percent weight loss due to attack by the decay fungi: *G. trabeum* | *C. versicolor* |
|---|---|---|---|---|
| UDPF + NP1 | 10 | 0.75 | 2.32 | 4.08 |
| NP1 | | 0.05 | 38.30 | 27.16 |
| NP1 | | 0.09 | 33.85 | 27.80 |
| NP1 | | 0.19 | 32.82 | 23.52 |
| NP1 | | 0.37 | 29.96 | 20.96 |
| NP1 | | 0.75 | 14.87 | 5.48 |
| NP1 | | 1.50 | 2.06 | -0.33 |
| NP1 | | 3.00 | 0.50 | 0.32) |
| UDPF | 10 | | 38.64 | 10.53 |
| UDPF | 30 | | 7.27 | 2.80 |
| UDPF | 50 | | 2.57 | 3.41 |
| Control | 0 | 0.00 | 37.15 | 30.83 |

A synergistic effect between the two components of this mixture in suppressing brown rot decay fungi occurred as shown below:

Percent reduction in attack by *G. trabeum* as determined by comparing % weight lost due to decay in treated blocks with % weight lost due to decay in untreated, control blocks.

| Chemical treatment | Reduction in decay caused by *G. trabeum* % |
|---|---|
| 0.75% NP1, alone | 59.97 |
| 10% UDPF, alone | (+1.49) |
| Sum of % reduction by above | 58.48 |
| combined treatment = (0.75% NP1 + 10% UDPF) | 93.76 |

EXAMPLE 7

MDPF+NP1, Preservative Effectiveness

Treated, cured wood blocks were evaluated for resistance to attack by two wood decay fungi, *Gleophyllum trabeum* (isolate Madison 617) and *Coriolus versicolor* (Madison isolate 697) employing the so-called soilblock test set forth in ASTM D 1413-78. The decay resistance of ¾"×¾"×¾" southern pine sapwood blocks, treated with a mixture of 10% MDPF and 0.75%, 1.50% or 7.50% NP1 was compared with the decay resistance of southern pine sapwood blocks treated with MDPF (10 or 30% solutions) alone, and with the decay resistance of southern pine sapwood blocks treated with NP1 alone at concentrations of 0.05, 0.09, 0.19, 0.37, 0.75, 1.50 and 3.0% NP1. Untreated southern pine sapwood blocks were used as controls. The impregnation treatment was as described in ASTM D 1413-78. Blocks are subjected to vacuum at 28 in. Hg for thirty minutes, flooded with the treating solution while under vacuum, and then held under the solution at atmospheric pressure for at least 30 minutes. This procedure simulates the indepth penetration achieved in dimension materials in industrial procedures with the full cell process. All treated blocks were subjected to leaching as described in ASTM D 1413-78 prior to exposure to the decay fungi. In the table below, the mean, percent weight loss due to attack by weather of the decay fungi in 5 replicate blocks is set forth.

TABLE 4

| Chemical component | MDPF % | NP1 % | Percent weight loss due to attack by the decay fungi: *G. trabeum* | *C. versicolor* |
|---|---|---|---|---|
| MDPF + NP1 | 10 | 0.75 | 4.54 | 0.10 |
| MDPF + NP1 | 10 | 1.50 | 0.61 | 0.40 |
| MDPF + NP1 | 10 | 7.50 | 0.04 | 0.08 |
| NP1 | | 0.05 | 38.30 | 27.16 |
| NP1 | | 0.09 | 33.85 | 27.80 |
| NP1 | | 0.19 | 32.82 | 23.52 |
| NP1 | | 0.37 | 29.96 | 20.96 |
| NP1 | | 0.75 | 14.87 | 5.48 |
| NP1 | | 1.50 | 2.06 | −0.33 |
| NP1 | | 3.00 | 0.50 | 0.32) |
| MDPF | 10 | | 34.08 | 9.00 |
| MDPF | 30 | | 4.65 | 3.12 |
| Control | 0 | 0.00 | 37.15 | 30.83 |

A synergist effect between the two components of this mixture in suppressing brown rot decay fungi occurs as shown below:

Percent reduction in attack by *G. trabeum* as determined by comparing % weight lost due to decay in treated blocks with % weight lost due to decay in untreated, control blocks.

| Chemical treatment | Reduction in decay caused by *G. trabeum* % |
|---|---|
| 0.75% NP1, alone | 69.30 |
| 10% MDPF, alone | 8.26) |
| Sum of % reduction by above | 77.56 |
| combined treatment = (0.75% DDAC + 10% MDPF) | 85.88 |

EXAMPLE 8

Tests to Determine if the Preservative Diminished the Effectiveness of Fire Retardant The effect of the preservative on the fire retardancy effectiveness of the UDPF system was evaluated using the fire tube test method ASTM E69-80. Southern pine sticks (⅜-in by ¾-in by 40-in in length) were treated with a 25% solution of UDPF in combination with DDAC at preservative retention levels of 0.0, 0.38, 0.75, and 3.6 pounds per cubic foot (pcf). After treatment, the specimens were dried at 150 degrees F. for 5 days then equilibrated to a constant moisture content of 73 degrees F., 50% relative humidity. When equilibrium moisture content was attained, the specimens were tested according to ASTM E69, the fire tube test method. The effect of the fire retardancy on the weight loss of the specimen was measured and the results are listed in Table 5.

TABLE 5

| Specimen | Preservative Retention Level | % Weight Loss Mean | Standard Deviation |
|---|---|---|---|
| UDPF/DDAC | 0.0 | 12.9 | 1.02 |
| | 0.37 | 13.1 | 1.07 |
| | 0.75 | 12.9 | 1.37 |
| | 3.6 | 13.1 | 1.69 |

TABLE 5-continued

| Specimen | Preservative Retention Level | % Weight Loss Mean | Standard Deviation |
|---|---|---|---|
| Control | — | 81.2 | 2.23 |

The results indicate that the loading level of the preservative in the fire retardant solution did not diminish the fire retardancy effectiveness of the fire retardant solution.

EXAMPLE 9

Optimizing Loading Level of Fire Retardance: Heat Release Rate Tests

A series of Pacific silver fir shakes, 6-in. by 6-in. by ½-inch were treated with various combinations of UDPF/DDAC, MDPF/DDAC, UDPF/NP-1, and MDPF/NP-1. The specimens were treated using a full-cell pressure impregnation technique. After treatment, the specimens were dried at 120 degrees F. for 2 days, then at 160 degrees F. for 2 days. Because the combined preservative/fire retardant system needs to be cured at temperatures around 180 degrees F., the specimens were then cured at 180 degrees F. for 2 days. Four specimens were treated at the concentrations listed in Table 6A. Two of the four specimens were then subjected to a 2 week leaching test. The leached specimens were placed in containers and covered with distilled water. The water was replaced after 6, 30, 78, 126, 174, 222, 270, and 318 hours after initiation of leaching experiment. After leaching tests were completed, the specimens were dried at 120 degrees F. for 2 days, followed by 140 degrees F. for 2 days then placed in a 73 degree F., 50% relative humidity room for equilibration. After the specimens reached equilibrium moisture content, heat release rate tests, according to ASTM D 906-90, were performed on the leached and unleached specimens. The results are listed in Table 6B. FIG. 1 shows the comparison of the leached and unleached results in relation to known materials with specified flamespread classification.

Although there is some loss of fire retardancy effectiveness after the 14 day leaching tests, the higher loading levels still retained enough fire retardancy effectiveness to remain within the class 1 specification. Some loss of chemical was anticipated due to the severity of this type of leaching experiment.

TABLE 6 A

| Specimen Label | Preservative | Concentration of UDPF (Wt %) | Average Retention of UDPF (pcf) | Average Retention of Preservative (pcf) |
|---|---|---|---|---|
| U17-20 | DDAC | 7.5 | 3.49 | 0.71 |
| U1-4 | DDAC | 10.0 | 4.81 | 0.69 |
| U5-8 | DDAC | 15.0 | 7.30 | 0.70 |
| U9-12 | DDAC | 20.0 | 9.65 | 0.75 |
| U13-16 | DDAC | 25.0 | 12.45 | 0.75 |
| U100-105 | NP-1 | 7.5 | 3.82 | 0.79 |
| U106-111 | NP-1 | 10.0 | 5.15 | 0.79 |
| U112-117 | NP-1 | 15.0 | 8.08 | 0.83 |
| U118-123 | NP-1 | 20.0 | 11.00 | 0.85 |
| U124-129 | NP-1 | 25.0 | 13.50 | 0.84 |
| | | Concentration of MDPF (Wt %) | Average Retention of MDPF (pcf) | Average Retention of Preservative (pcf) |
| M1-4 | DDAC | 7.5 | 3.60 | 0.70 |
| M5-8 | DDAC | 10.0 | 4.90 | 0.70 |
| M9-12 | DDAC | 15.0 | 7.36 | 0.74 |
| M13-16 | DDAC | 20.0 | 9.72 | 0.68 |
| M17-20 | DDAC | 25.0 | 11.91 | 0.69 |
| M100-105 | NP-1 | 7.5 | 3.92 | 0.81 |
| M106-111 | NP-1 | 10.0 | 5.22 | 0.81 |
| M112-117 | NP-1 | 15.0 | 7.97 | 0.82 |
| M118-123 | NP-1 | 20.0 | 11.00 | 0.85 |
| M124-129 | NP-1 | 25.0 | 13.95 | 0.86 |

TABLE 6 B

| Specimen | FR (pcf) | HRR Before Leaching | HRR After Leaching |
|---|---|---|---|
| Control | 0.0 | 92.7 | 86.5 |
| UDPF/DDAC | 3.49 | 32.7 | 85.6 |
| UDPF/DDAC | 4.81 | 27.9 | 75.2 |
| UDPF/DDAC | 7.30 | 15.6 | 63.3 |
| UDPF/DDAC | 9.65 | 6.4 | 26.2 |
| UDPF/DDAC | 12.45 | 5.4 | 14.5 |
| UDPF/NP-1 | 3.82 | NA | 107.0 |
| UDPF/NP-1 | 5.15 | 60.3 | 97.9 |
| UDPF-NP-1 | 8.08 | 12.7 | 28.8 |
| UDPF-NP-1 | 11.00 | 14.4 | 13.6 |
| UDPF-NP-1 | 13.50 | 11.2 | 14.1 |
| MDPF/DDAC | 3.60 | 52.5 | 83.2 |
| MDPF/DDAC | 4.90 | 23.3 | 87.3 |
| MDPF/DDAC | 7.36 | 15.4 | 57.7 |
| MDPF/DDAC | 9.72 | 9.5 | 29.9 |
| MDPF/DDAC | 11.91 | 5.9 | 24.7 |
| MDPF/NP-1 | 3.92 | 55.4 | 85.2 |
| MDPF/NP-1 | 5.22 | 45.0 | 93.9 |
| MDPF/NP-1 | 7.97 | 17.3 | 35.7 |
| MDPF/NP-1 | 11.00 | 14.0 | 19.2 |
| MDPF/NP-1 | 13.95 | 14.4 | 19.6 |

EXAMPLE 10

Optimizing Loading Level of Fire Retardancy: Fire Tube Tests

Figure 2:
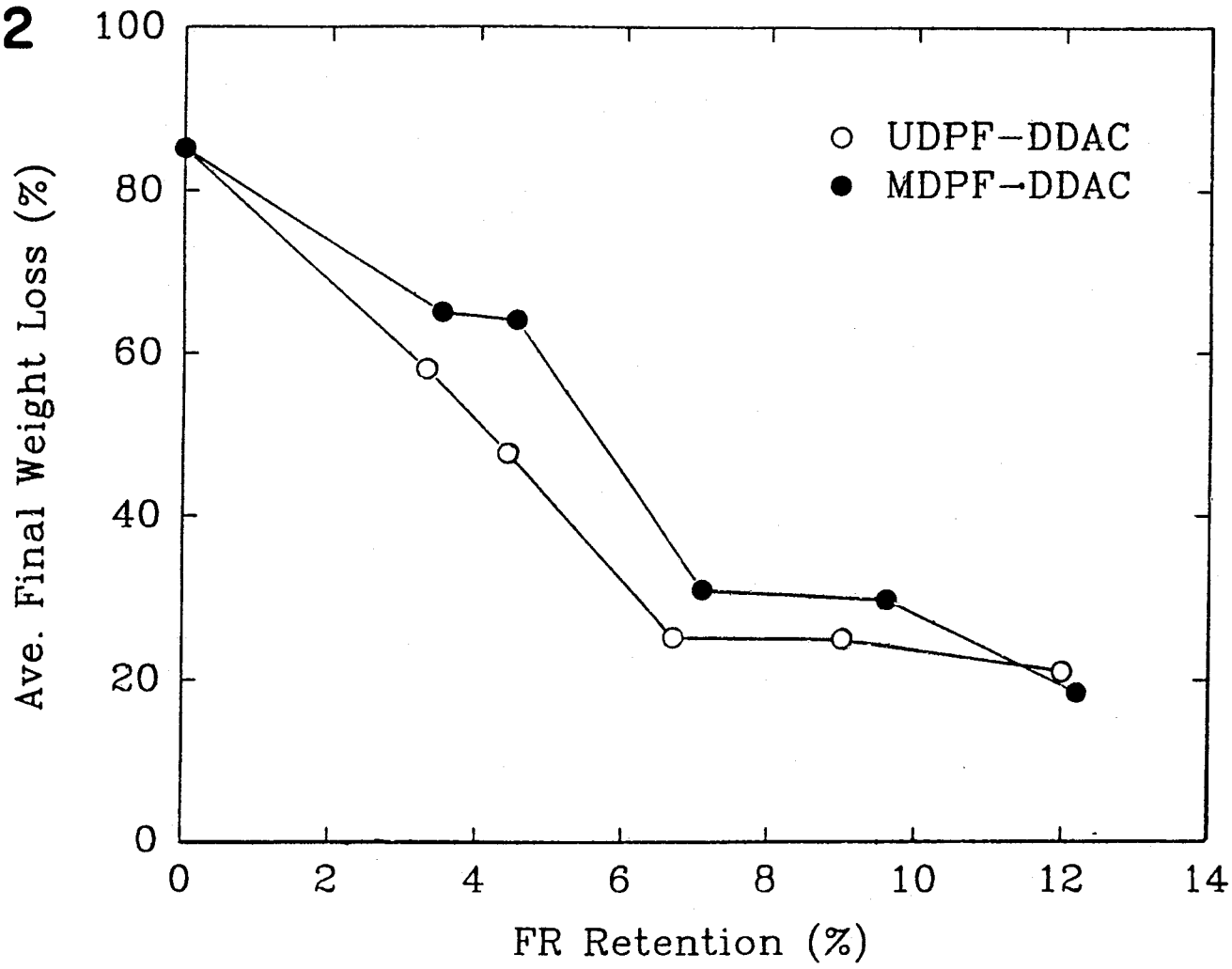
FIG. 2 Summary of optimization experiments on Western Whitewood of fire retardant loading levels as measured by fire tube tests.

Southern pine fire tube sticks were treated to the same loading levels of UDPF/DDAC and MDPF/DDAC as in Table 6A. The average retention of the fire tube specimens are listed in Table 7A. The specimens were treated using a full cell pressure impregnation technique. After treatment, the fire tubes were dried the same as in example 9. The results of the fire tube sticks listed in Table 7 are contained in Table 7B and FIG. 2.

TABLE 7A

| Specimen Label | Preservative | Concentration of UDPF (Wt %) | Average Retention of UDPF (pcf) | Average Retention of Preservative (pcf) |
|---|---|---|---|---|
| UT 17-20 | DDAC | 7.5 | 3.28 | 0.62 |
| UT 1-5 | DDAC | 10.0 | 4.90 | 0.63 |
| UT 6-10 | DDAC | 15.0 | 6.68 | 0.72 |
| UT 11-15 | DDAC | 20.0 | 8.97 | 0.63 |
| UT 16-20 | DDAC | 25.0 | 12.01 | 0.69 |
| MT 1-5 | DDAC | 7.5 | 3.49 | 0.71 |
| MT 6-10 | DDAC | 10.0 | 4.46 | 0.64 |
| MT 11-15 | DDAC | 15.0 | 7.14 | 0.76 |
| MT 16-20 | DDAC | 20.0 | 9.61 | 0.69 |
| MT 21-25 | DDAC | 25.0 | 12.23 | 0.77 |

TABLE 7B

| Specimen | Fire tube number | Solution concentration (%) | Retention (pcf) | Final weight loss (%) |
|---|---|---|---|---|
| UDPF/DDAC | UT 21-25 | 7.5 | 3.3 | 58.0 |
| UDPF/DDAC | UT 1-5 | 10.0 | 4.4 | 47.6 |
| UDPF/DDAC | UT 6-10 | 15.0 | 6.7 | 25.2 |
| UDPF/DDAC | UT 11-15 | 20.0 | 9.0 | 25.0 |

TABLE 7B-continued

| Specimen | Fire tube number | Solution concentration (%) | Retention (pcf) | Final weight loss (%) |
|---|---|---|---|---|
| UDPF/DDAC | UT 16-20 | 25.0 | 12.0 | 21.0 |
| MDPF/DDAC | MT 1-5 | 7.5 | 3.5 | 65.0 |
| MDPF/DDAC | MT 6-10 | 10.0 | 4.5 | 64.0 |
| MDPF/DDAC | MT 11-15 | 15.0 | 7.1 | 31.0 |
| MDPF/DDAC | MT 16-20 | 20.0 | 9.6 | 29.8 |
| MDPF/DDAC | MT 21-25 | 25.0 | 12.2 | 18.4 |
| CONTROLS | CT 1-5 | — | — | 85.2 |

EXAMPLE 11

Evaluation of Weathered and Unweathered Shakes Treated with Combined System

Pacific silver fir and western hemlock shakes were treated with various concentrations of the UDPF/-DDAC and MDPF/DDAC system. The shakes were treated using a full-cell pressure impregnation. A vacuum treatment of 30 inches of Hg was pulled for 30 minutes. The fire retardant preservative system was applied at a pressure of 150 psi, for 90 minutes. After treatment, the shakes were kiln dried. Kiln samples were used to monitor the weight loss. The kiln schedule involved using a dry bulb temperature of 120 degrees F. and a wet bulb temperature of 113 degrees F. for 6 days. Both the dry bulb and wet bulb temperature were then increased 10 degrees on each of the following days until 180 degrees F. was reached for the dry bulb temperature. The shakes were allowed to cure at 180 degrees F. for approximately 48 hours. Decks, 12-in. by 31-in. in length were constructed of the treated specimens. Standard ASTM E 108-88 procedures for constructing the class C burning brand decks were followed except for the size. The modified Schlyter decks were constructed following the procedure given in LeVan and Holmes (1986). Four modified Schlyter decks of each fire retardant/preservative system were constructed. Two Class C burning brand decks of each system were also constructed. Two of the modified Schlyter decks and one of the burning brand decks were then subjected to 1,000 hours of weathering according to ASTM D2898 B. After weathering, the Class C burning brand test and the modified Schlyter test were performed on both the unweathered and weathered specimens. The fire test results are given in Table 8.

TABLE 8

| Specimen | FR Type | FR (pct) | PRE Type | PRE (pcf) | BB unweathered | BB weathered | MS unweathered | MS weathered |
|---|---|---|---|---|---|---|---|---|
| Untreated PFS | | | | | 16/16 | 16/16 | NA | NA |
| Untreated PFS | | | | | NA | NA | NA | NA |
| WH | | | | | 16/16 | 16/16 | NA | NA |
| Treated | | | | | | | | |
| E-WH | UDPF | 9.5 | — | — | 0/16 | 0/16 | 24 | 28 |
| E-PSF | UDPF | 9.5 | — | — | 0/16 | 0/16 | 28 | 40 |
| M-WH | UDPF | 9.5 | DDAC | 0.30 | 0/16 | 0/16 | 28 | 26 |
| M-PSF | UDPF | 9.5 | DDAC | 0.30 | 0/16 | 0/16 | 32 | 22 |
| N-WH | UDPF | 9.5 | DDAC | 0.60 | 0/16 | 0/16 | 28 | 28 |
| N-PSF | UDPF | 9.5 | DDAC | 0.60 | 0/16 | 0/16 | 36 | 30 |
| C-WH | UDPF | 6.5 | — | — | NA | NA | NA | NA |
| C-PSF | UDPF | 6.5 | — | — | NA | NA | NA | NA |
| K-WH | UDPF | 6.5 | DDAC | 0.30 | 0/16 | 0/16 | 34 | 28 |
| K-PSF | UDPF | 6.5 | DDAC | 0.30 | 0/16 | 0/16 | 26 | 30 |
| L-WH | UDPF | 6.5 | DDAC | 0.60 | 0/16 | NA | 36 | NA |
| L-PSF | UDPF | 6.5 | DDAC | 0.60 | 0/16 | NA | 32 | NA |
| G-WH | UDPF | 2.8 | — | — | 0/16 | NA | 42 | NA |
| G-PSF | UDPF | 2.8 | — | — | 0/16 | NA | 34 | NA |
| I-WH | UDPF | 2.8 | DDAC | 0.30 | NA | NA | NA | NA |
| I-PSF | UDPF | 2.8 | DDAC | 0.30 | NA | NA | NA | NA |
| J-WH | UDPF | 2.8 | DDAC | 0.60 | NA | NA | NA | NA |
| J-PSF | UDPF | 2.8 | DDAC | 0.60 | NA | NA | NA | NA |

PSF = Pacific silver fir
WH = Western hemlock
8/8 = 8 failures out of 8 brands
0/16 = 0 failures out of 16 brands
NA = not available at this time
PRE = preservative
BB = burning brand
MS = modified Schlyter From the above tables of results and reference to the plots in the accompanying figures, it is evident that the present invention provides an effective one step system for imparting both decay resistence and fire retardance to products composed primarily of wood.

It is understood that the foregoing detailed description is given merely by way of illustration and that modification and variations may be made therein without departing from the spirit and scope of the invention.

We claim:

1. A one step process for imparting both fire retardance and decay resistance to a product composed of cellulosic material comprising:

combining a first ingredient consisting of a methylolated amino resin present in a range of about 5% to about 40% by weight of the final solids content with a second ingredient selected from the group consisting of tertiary and quaternary ammonium compounds present in a range of about 0.1% to about 10% by weight of the final solids content to produce a water-soluble mixture, and impregnating said product with said mixture.

2. The process as claimed in claim 1 wherein said second ingredient is a tertiary ammonium compound.

3. The process as claimed in claim 1 wherein said second ingredient is a quaternary ammonium compound.

4. The process as claimed in claim 3 wherein said second ingredient is didecyl dimethyl ammonium chloride.

5. The process as claimed in claim 3 wherein said second ingredient is a combination of didecyl dimethyl ammonium chloride with 3-iodo-2-propynyl-butyl carbamate.

6. The process as claimed in claim 1 wherein said process is a full cell pressure impregnation process for the impregnation of said product.

7. The process as claimed in claim 3 wherein said product is composed primarily of cellulosic materials.

8. The process as claimed in claim 1 wherein said product is composed primarily of wood.

9. The process as claimed in claim 3 wherein said first ingredient is present in the range of about 7.5% to 25% by weight of the final solids content.

10. The process as claimed in claim 5 wherein said second ingredient is didecyl dimethyl ammonium chloride present in the range of about 0.19% to 7.5% by weight of the final solids content.

11. The process as claimed in claim 5 wherein said second ingredient is a combination of didecyl dimethyl ammonium chloride with 3-iodo-2-propynyl-butyl carbamate present in the range of about 0.09% to about 7.5% by the weight of final solids content.

12. A product produced according to the process of claim 1.

13. A product produced according to the process of claim 1 wherein said product is composed primarily of cellulosic materials.

14. A product produced according to the process of claim 1 wherein said product is composed primarily of wood.

15. A product according to the process of claim 1 wherein said product is composed entirely of wood.

16. A one step process for imparting both fire retardance and decay resistance to a product composed of cellulosic material comprising:

combining a first ingredient consisting of a guanyl urea phosphate present in a range of about 5% to about 40% by weight of the final solids content with a second ingredient selected from the group consisting of tertiary and quaternary ammonium compounds present in a range of about 0.1% to about 10% by weight of the final solids content to produce a water-soluble mixture, and impregnating said product with said mixture.

17. A one step process for imparting both fire retardance and decay resistance to a product composed of cellulosic material comprising:

combining a first ingredient consisting of melaminedicyandiamide-phosphoric acid-formaldehyde present in a range of about 5% to about 40% by weight of the final solids content with a second ingredient selected from the group consisting of tertiary and quaternary ammonium compounds present in a range of about 0.1% to about 10% by weight of the final solids content to produce a water-soluble mixture, and impregnating said product with said mixture.

18. A one step process for imparting both fire retardance and decay resistance to a product composed of cellulosic material comprising:

combining a first ingredient consisting of urea-dicyandiamide-phosphoric acid-formaldehyde present in a range of about 5% to about 40% by weight of the final solids content with a second ingredient selected from the group consisting of tertiary and quaternary ammonium compounds present in a range of about 0.1% to about 10% by weight of the final solids content to produce a water-soluble mixture, and impregnating said product with said mixture.

19. A one step process for imparting both fire retardance and decay resistance to a product composed of cellulosic material comprising:

combining a first ingredient consisting of dicyandiamide-phosphoric acid-formaldehyde present in a range of about 5% to about 40% by weight of the final solids content with a second ingredient selected from the group consisting of tertiary and quaternary ammonium compounds present in a range of about 0.1% to about 10% by weight of the final solids content to produce a water-soluble mixture, and impregnating said product with said mixture.

* * * * *